US009406257B2

(12) United States Patent
Nakamura

(10) Patent No.: US 9,406,257 B2
(45) Date of Patent: Aug. 2, 2016

(54) DISPLAY DEVICE AND METHOD FOR DRIVING SAME

(71) Applicant: Japan Display Inc., Tokyo (JP)

(72) Inventor: Norio Nakamura, Tokyo (JP)

(73) Assignee: JAPAN DISPLAY INC., Tokyo (JP)

( * ) Notice: Subject to any disclaimer, the term of this patent is extended or adjusted under 35 U.S.C. 154(b) by 137 days.

(21) Appl. No.: 14/484,314

(22) Filed: Sep. 12, 2014

(65) Prior Publication Data

US 2015/0077412 A1 Mar. 19, 2015

(30) Foreign Application Priority Data

Sep. 13, 2013 (JP) ..... 2013-190546

(51) Int. Cl.
*G09G 3/32* (2016.01)

(52) U.S. Cl.
CPC ..... *G09G 3/3233* (2013.01); *G09G 2300/0452* (2013.01); *G09G 2300/0819* (2013.01); *G09G 2300/0842* (2013.01); *G09G 2300/0852* (2013.01); *G09G 2300/0861* (2013.01); *G09G 2310/0254* (2013.01); *G09G 2320/043* (2013.01)

(58) Field of Classification Search
CPC ..... G09G 3/3233; G09G 2300/0819; G09G 2300/0842; G09G 2310/0254; G09G 2300/0861; G09G 2320/043; G09G 2300/0452; G09G 2300/0852
See application file for complete search history.

(56) References Cited

U.S. PATENT DOCUMENTS

| | | | | |
|---|---|---|---|---|
| 6,229,506 | B1 | 5/2001 | Dawson et al. | |
| 2010/0079419 | A1* | 4/2010 | Shibusawa | H01L 27/3272 345/204 |
| 2012/0133272 | A1* | 5/2012 | Tamaki | G09G 3/3233 313/504 |
| 2013/0002635 | A1* | 1/2013 | Yamashita | G09G 3/3233 345/211 |
| 2013/0335307 | A1* | 12/2013 | Guo | G09G 3/3258 345/76 |

FOREIGN PATENT DOCUMENTS

| | | | |
|---|---|---|---|
| JP | 2007-310311 | A | 11/2007 |
| JP | 2011-145622 | A | 7/2011 |

* cited by examiner

*Primary Examiner* — Premal Patel
(74) *Attorney, Agent, or Firm* — Typha IP LLC

(57) ABSTRACT

In a display device, a signal line drive circuit applies an initialization voltage to control terminals of drive transistors from corresponding video signal lines, and applies a reset potential to first terminals of the drive transistors from corresponding reset lines to initialize the drive transistor, and the initialization voltage is set to a lower value as a voltage value of the gradation voltage signal written after offset cancellation for offset-canceling a threshold value of the drive transistor is higher.

6 Claims, 10 Drawing Sheets

DISPLAY DEVICE AND METHOD FOR DRIVING SAME

CROSS-REFERENCE TO RELATED APPLICATION

The present application claims priority from Japanese application JP2013-190546 filed on Sep. 13, 2013, the content of which is hereby incorporated by reference into this application.

BACKGROUND OF THE INVENTION

1. Field of the Invention

The present invention relates to a display device and a method for driving the display device, and more particularly to an active matrix display device, and a method for driving the display device.

2. Description of the Related Art

In recent years, a demand for flat panel display devices typified by a liquid crystal display device has rapidly increased taking advantage of the features of thin, lightweight, and low power consumption. Among them, an active matrix display device in which pixel switches having a function of electrically isolating on pixels and off pixels from each other, and holding video signals for the on pixels are disposed in the respective pixels is used in various displays including a portable information equipment.

As the active matrix display devices of this flat panel type, attention has been paid to an organic EL display device using self-luminous elements, and actively researched and developed. The organic EL display device requires no backlight, and is suitable for moving image reproduction because of high-speed response, and also suitable for use in cold climates because brightness is not lowered at low temperature.

In general, the organic EL display device has plural display pixels that are arrayed in plural rows and plural columns, and configure a display screen. Each of the display pixels includes an organic EL element which is a self-luminous element, and a pixel circuit that supplies a drive current to the organic EL element, and a light emission brightness of the organic EL element is controlled to conduct display operation.

U.S. Pat. No. 6,229,506 discloses a system of driving the pixel circuits with the use of a voltage signal. Also, JP 2007-310311 A and JP 2011-145622 A propose a display device that switches a voltage source to low or high, and also outputs both of a video signal and an initialization signal from video signal lines to reduce the number of components and the number of lines for the display elements, and reduces a layout area of the display pixels to perform high definition.

SUMMARY OF THE INVENTION

However, in order to comfortably display an image in the above display device, there is a need to improve a relationship between the gradation of the video signals and the brightness of the screen to improve dynamic range and contrast.

Under the circumstances, the invention has been made in view of the above problem, and aims at providing a display device that improves the dynamic range and the contrast, and a method of driving the display device.

According to the invention, there is provided a display device, including: a plurality of pixel units that are arrayed on a substrate in a matrix, and each having a drive transistor, an output switch, a retention capacitor, a pixel switch, a light emitting element, and a pixel circuit that supplies a drive current to the light emitting element; a plurality of first scanning lines, a plurality of second scanning lines, and a plurality of third scanning lines, which are plural kinds of scanning lines arranged along rows in which the pixel units are arrayed; a plurality of video signal lines that are arranged along columns in which the pixel units are arrayed; a plurality of reset lines that are arranged along the rows; a high-potential voltage power supply line, and a low-potential voltage power supply line; a scanning line drive circuit that includes a plurality of reset switches, sequentially supplies a control signal to the plural kinds of scanning lines, and line-sequentially scans the pixel units line by line; and a signal line drive circuit that supplies a gradation voltage signal corresponding to the video signal to the video signal lines according to the line-sequentially scanning operation, in which the drive transistor is connected in series with the light emitting element between the low-potential voltage power supply line and the high-potential voltage power supply line, a first terminal of the drive transistor is connected to the light emitting element, and a second terminal of the drive transistor is connected to the corresponding reset line, in which a first terminal of the output switch is connected to a high-potential voltage power supply, a second terminal of the output switch is connected to the second terminal of the drive transistor, and a control terminal of the output switch is connected to the corresponding first scanning line, in which the retention capacitor is connected between the first terminal of the drive transistor and a control terminal of the drive transistor, in which a first terminal of the pixel switch is connected to the corresponding video signal line, a second terminal of the pixel switch is connected to the control terminal of the drive transistor, and a control terminal of the pixel switch is connected to the corresponding second scanning line, and the pixel switch captures the gradation voltage signal from the corresponding video signal line, and retains the gradation voltage signal in the retention capacitor, in which the output switch is shared by four of the pixel units adjacent to each other in a row direction and a column direction, in which the respective reset switches are disposed for every reset line, a first terminal of each of the reset switches is connected to a reset power supply, a second terminal of the reset switch is connected to the corresponding reset line, and a control terminal of the reset switch is connected to the corresponding third scanning line, and in which the signal line drive circuit applies an initialization voltage to the control terminal of the drive transistor from the corresponding video signal line, applies a reset potential to the first terminal of the drive transistor from the corresponding reset line to initialize the drive transistor, and the initialization voltage is set to a lower value as a voltage value of the gradation voltage signal written after offset cancellation for offset-canceling a threshold value of the drive transistor is higher.

Also, according to the invention, there is provided a method for driving the display device, which conducts (1) source initializing operation of applying the reset power supply to the second terminal of the drive transistor from the corresponding reset line; (2) gate initializing operation of initializing the drive transistor by applying the initialization voltage to the control terminal of the drive transistor from the corresponding video signal line, and applying the reset potential to the first terminal of the drive transistor from the corresponding reset line; (3) offset cancelling operation of offset-cancelling the threshold value of the drive transistor by allowing a current to flow into the drive transistor from the high-potential voltage power supply in a state where the initialization voltage is applied to the control terminal of the drive transistor from the corresponding video signal line, (4) video signal writing operation of allowing a current to flow into the low-potential voltage power supply line from the high-potential voltage power supply line through the drive transistor while writing the gradation voltage signal to the control terminal of the drive transistor from the corresponding video signal line; and (5) light emitting operation of supplying the drive current corresponding to the gradation voltage signal to the light emitting element from the high-potential voltage power supply line through the drive transistor, in which the initialization voltage is set to a lower value as a voltage value of the gradation voltage signal written after offset cancellation for offset-canceling a threshold value of the drive transistor is higher.

According to the display device and the method for driving the display device of the invention, the dynamic range and the contrast are improved.

DETAILED DESCRIPTION OF THE INVENTION

Hereinafter, a description will be given of a display device and a method for driving the display device according to embodiments of the invention with reference to the accompanying drawings.

First Embodiment

Hereinafter, a description will be given of a display device 10 and a method for driving the display device according to a first embodiment with reference to FIGS. 1 to 7.

1. Configuration of Display Device 10

Figure 1:
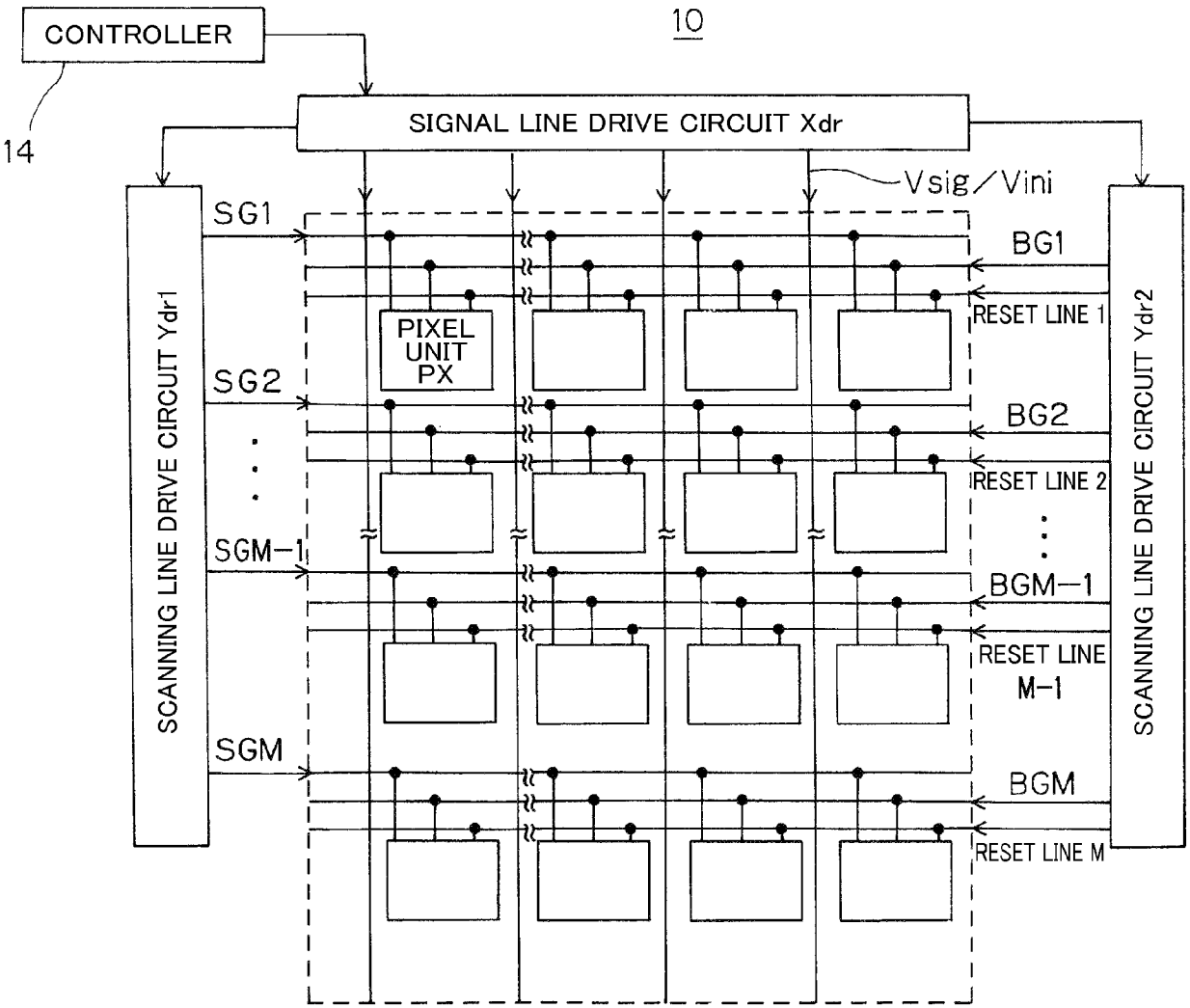
FIG. 1 is a diagram illustrating a configuration example of a display device according to a first embodiment.

The display device 10 according to this embodiment will be described with reference to FIG. 1. FIG. 1 is a plan view schematically illustrating the display device 10.

As illustrated in FIG. 1, the display device 10 is an organic EL display device that is configured as, for example, a 2-inch or larger active matrix display device 10, and includes an organic EL panel, and a controller that controls the operation of the organic EL panel. The organic EL panel includes an insulating substrate (not shown) having translucency such as a glass substrate, m×n pixel units (display pixels) PX that are arrayed on the insulating substrate in a matrix, and form a display area AA, first scanning lines Sga (1 to m) to third scanning lines Sgc (1 to m) that are connected to every row of the pixel units PX, and provided m by m, independently, and n video signal lines X (1 to n) that are connected to every column of the pixel units PX.

Also, the organic EL panel includes reset lines to be mentioned later that are connected to every line of the pixel units PX, and also provided m by m, independently, a high-potential voltage power supply line Pvdd, and a low-potential voltage power supply line Pvss.

The organic EL panel includes scanning line drive circuits Ydr1, Ydr2 that sequentially drive the first scanning lines Sga (1 to m), the second scanning lines Sgb (1 to m), and the third scanning lines Sgc (1 to m) for every row of the pixel units PX, and a signal line drive circuit Xdr that drives the plural video signal lines X (1 to n). The scanning line drive circuits Ydr1, Ydr2, and the signal line drive circuit Xdr are formed integrally on the insulating substrate outside the display area AA, and configure a control unit together with a controller 14.

Each of the pixel units PX includes a light emitting element having a photoactive layer (not shown) between a counter electrode (not shown) and the light emitting element, and a pixel circuit 12 that supplies a drive current to the light emitting element. The light emitting element is an organic EL element OE which is a self-luminous element having at least an organic light emitting layer as the photoactive layer.

2. Equivalent Circuit of Pixel Unit PX

Figure 2:
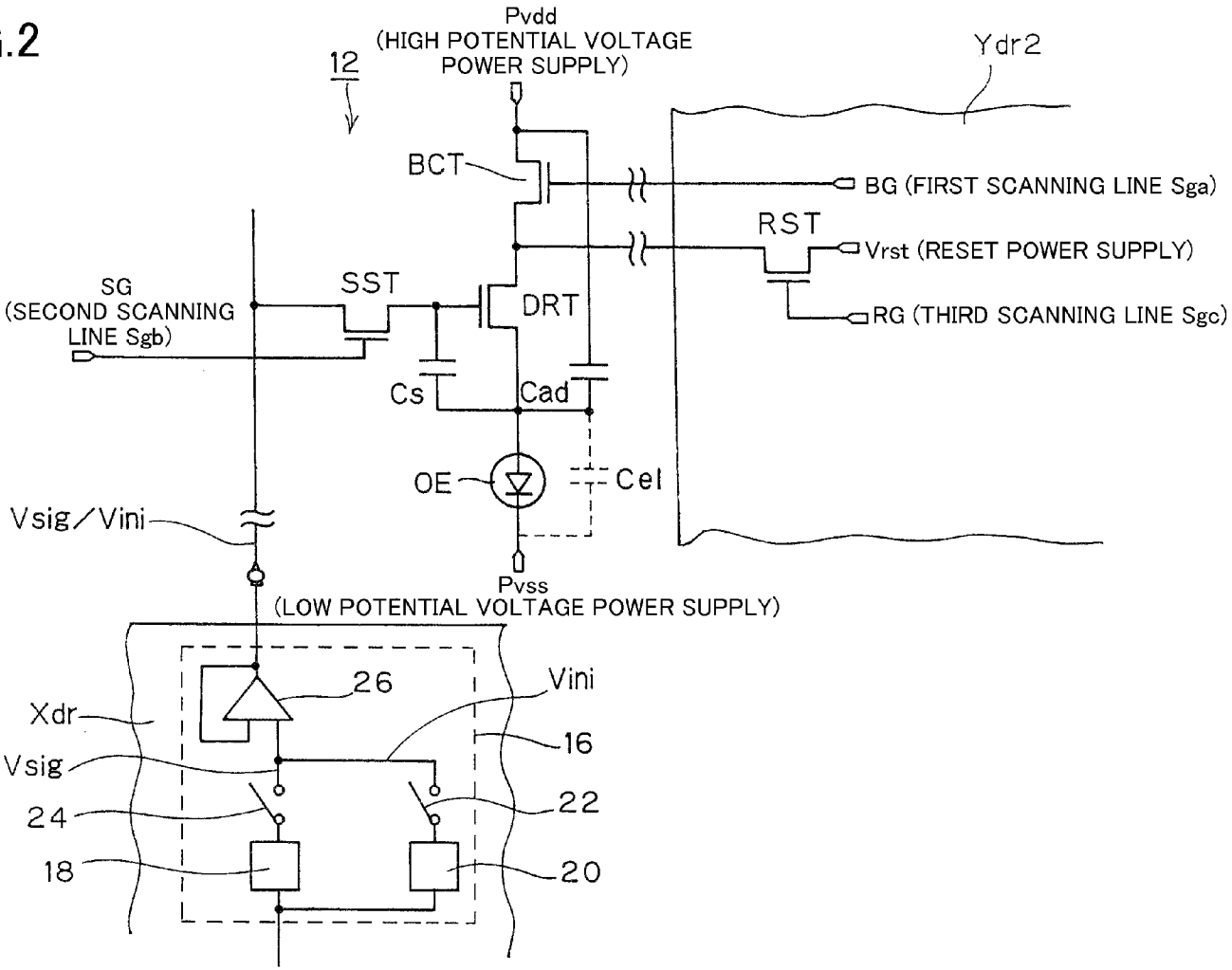
FIG. 2 is a diagram illustrating a pixel circuit.

An equivalent circuit of the pixel units PX will be described with reference to FIG. 2. FIG. 2 illustrates an equivalent circuit of the pixel units PX. The pixel circuit 12 of the respective pixel units PX is of a voltage signal system that controls the light emission of the organic EL element OE according to a video signal that is a gradation voltage signal, and has a pixel switch SST, a drive transistor DRT, a retention capacitor Cs as a capacitor, and an auxiliary capacitor Cad. The auxiliary capacitor Cad is an element disposed for adjusting an emission current amount, and may not be required in some cases.

Four pixel units PX adjacent to each other in the respective rows and the respective columns have one output switch BCT. That is, the output switch BCT is shared by these four pixel circuits 12. Further, the scanning line drive circuit Ydr1 (or the scanning line drive circuit Ydr2) is equipped with plural reset switches RST which are connected to the reset lines of the respective rows.

The pixel switches SST, the drive transistors DRT, the output switches BCT, and the reset switches RST are formed of the same conductivity type, for example, n-channel thin film transistors in this example. In the display device 10 according to this embodiment, all of the thin film transistors configuring the respective drive transistors and the respective switches are thin film transistors (TFT) with a top gate structure, which are formed in the same process, and with the same layer structure, and each have a semiconductor layer made of polysilicon. Each of the pixel switches SST, the drive transistors DRT, the output switches BCT, and the reset switches RST has a first terminal, a second terminal, and a control terminal. The first terminal, the second terminal, and the control terminal are configured by a source, a drain, and a gate in this embodiment, respectively.

The drive transistor DRT of the pixel unit PX for green (G) display and the output switch BCT are connected in series with the organic EL element OE between the high-potential voltage power supply line Pvdd and the low-potential voltage power supply line Pvss. The high-potential voltage power supply line Pvdd is set to a potential of, for example, 10V, and the low-potential voltage power supply line Pvss is set to a potential of, for example, 1.5V.

The output switch BCT has a first terminal (source in this example) connected to the high-potential voltage power supply line Pvdd, and a second terminal (drain in this example) connected to a second terminal (drain in this example) of the drive transistor DRT. A gate of the output switch BCT is connected to the first scanning lines Sga (1 to m). With this configuration, the output switch BCT is controlled to on (conductive state) or off (nonconductive state) according to a control signal BG (1 to m) from the first scanning lines Sga (1 to m) to control a light emitting time of the organic EL element OE.

The drive transistor DRT has a second terminal (drain in this example) connected to a drain of the output switch BCT, and the corresponding reset line, and a first terminal (source in this example) connected to one electrode (anode in this example) of the organic EL element OE. A cathode of the organic EL element OE is connected to the low-potential voltage power supply line Pvss. The drive transistor DRT outputs a drive current having the amount of current corresponding to the video signal to the organic EL element OE. Referring to FIG. 2, symbol Cel represents a parasitic capacitor of the organic EL element OE.

The pixel switch SST has a first terminal (source in this example) connected to the corresponding video signal line X (1 to n). A control terminal (gate in this example) of the pixel switch SST is connected to the corresponding second scanning line Sgb (1 to m) that functions as a signal write control gate line, and controlled to on/off according to a control signal SG (1 to m) supplied from the corresponding second scanning line Sgb (1 to m). The pixel switch SST controls connection and disconnection between the pixel circuit 12 and the corresponding video signal line X (1 to n) in response to the control signal SG (1 to m), and captures the gradation voltage signal from the corresponding video signal line X (1 to n) into the pixel circuit 12.

The respective reset switches RST are disposed for every row in the scanning line drive circuit, and the reset switches RST are each connected between the drain of the drive transistor DRT and a reset power supply Vrst. A gate of each reset switch RST is connected to the corresponding third scanning line Sgc (1 to m) that functions as a reset control gate line. The reset switches RST are each controlled to on/off according to a control signal RG (1 to m) from the corresponding third scanning line Sgc (1 to m) to initialize a source potential of the drive transistor DRT.

3. Layout Image of Scanning Lines

Figure 3:
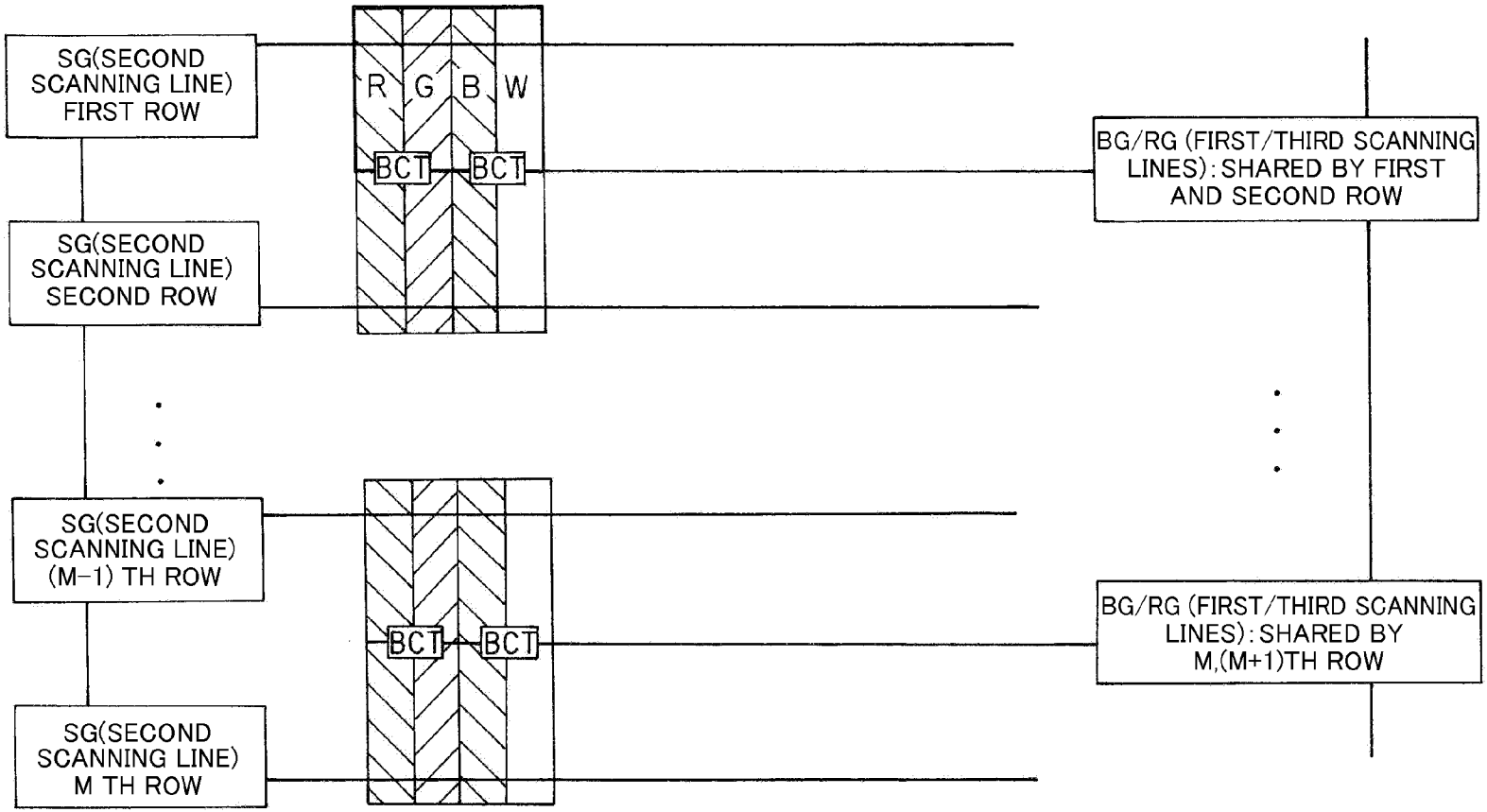
FIG. 3 is a diagram illustrating a scanning line layout image of vertical stripe pixels of four colors.

The layout image of the scanning lines will be described with reference to FIG. 3. FIG. 3 illustrates a scanning line layout image of vertical stripe pixels of four colors. In the scanning line layout image of the vertical stripe pixels of four colors, four pixel units PX for R (red) display, G (green) display, B (blue) display, and W (white) display are connected to each other on the same row.

The output switch BCT in this example is shared by the four pixel units PX in total including two pixel units PX adjacent to each other in the column direction, and two pixel units PX adjacent to each other in the row direction. Because the output switch BCT in this case are commonalized, the first scanning lines Sga (1 to m) and the third scanning lines Sgc (1 to m) are commonalized for every two lines. The number of scanning lines can be reduced to m/2.

4. Controller 14

The controller 14 is formed on a printed circuit board (not shown) arranged outside the organic EL panel, and controls the scanning line drive circuits Ydr1, Ydr2, and the signal line drive circuit Xdr. The controller 14 receives a digital video signal and a clock signal which are supplied from the external, and generates a vertical scanning control signal for controlling a vertical scanning timing, and a horizontal scanning control signal for controlling a horizontal scanning timing on the basis of the clock signal.

The controller 14 supplies the vertical scanning control signal and the horizontal scanning control signal to the scanning line drive circuits Ydr1, Ydr2, and the signal line drive circuit Xdr. Also, the controller 14 supplies the digital video signal to the signal line drive circuit Xdr in synchronization with the horizontal scanning timing and the vertical scanning timing.

5. Signal Line Drive Circuit Xdr

The signal line drive circuit Xdr coverts the digital video signals sequentially obtained in the respective horizontal scanning periods into analog video signals under the control of the horizontal scanning control signal from the controller 14, and supplies gradation voltage signals Vsig of plural gradations corresponding to the analog video signals to the plural video signal lines X (1 to n) in parallel.

The signal line drive circuit Xdr is equipped with initialization voltage circuits 16 that output an initialization voltage Vini used in gate initialization operation and offset cancel operation which will be described later. The initialization voltage circuit 16 is disposed for each of the plural video signal lines. The initialization voltage circuits 16 each include an arithmetic unit 20 that calculates the initialization voltage Vini in correspondence with the gradation voltage signals Vsig into which the analog video signal is subjected to A/D conversion, a storage unit 18, which retards an output of the gradation voltage signals Vsig only while the arithmetic unit 20 is conducting arithmetic operation, switches 22, 24, and an amplifier 26.

6. Scanning Line Drive Circuits Ydr1 and Ydr2

The scanning line drive circuits Ydr1 and Ydr2 each include a shift register (not shown), and an output buffer (not shown), sequentially transfer a horizontal scanning start pulse which is one of the horizontal scanning control signals supplied from the controller 14 to a subsequent stage, and supply three kinds of control signals BG (1 to m), SG (1 to m), and RG (1 to m) to the pixel units PX in the respective rows through an output buffer as illustrated in FIGS. 1 and 2.

With the above configuration, the first scanning lines Sga (1 to m), the second scanning lines Sgb (1 to m), and the third scanning lines Sgc (1 to m) are driven according to the control signals BG (1 to m), SG (1 to m), and RG (1 to m), respectively.

7. Operation of Display Device 10

Subsequently, a description will be given of the operation of the pixel circuit 12 in the display device 10 configured as described above. The operation of the pixel circuit 12 is classified into source initialization operation, gate initialization operation, offset cancel operation, video signal write operation, and light emitting operation.

Figure 4:
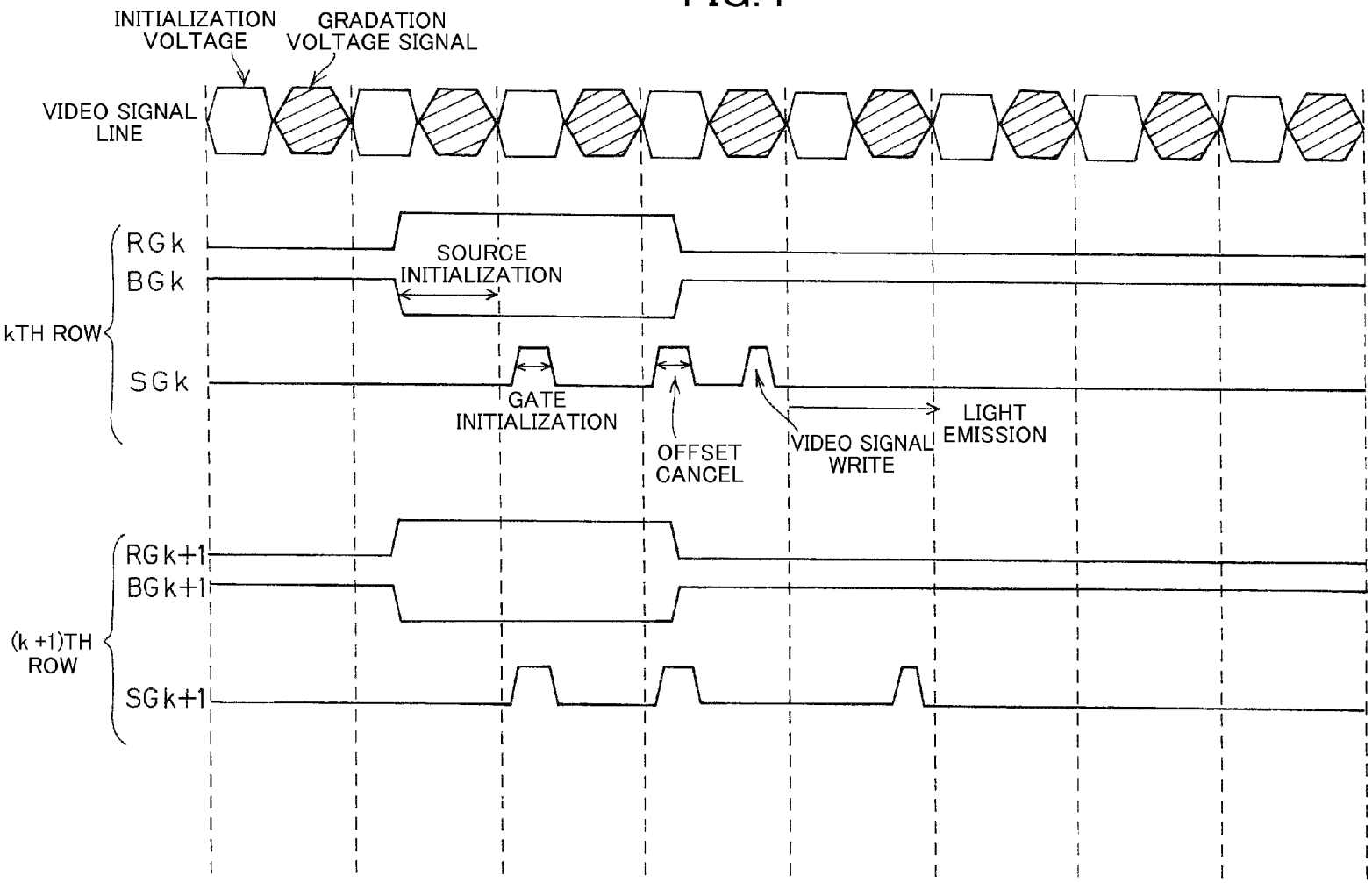
FIG. 4 is a timing chart of a control signal of a scanning line drive circuit.

FIG. 4 is a timing chart of the control signals of the scanning line drive circuits Ydr1 and Ydr2 in the display operation in which an offset cancel period is once in the vertical stripe pixels.

7-1. Source Initialization Operation

First, the source initialization operation is conducted. In the source initialization operation, the control signal SG is set to a level (off potential: low level in this example) at which the pixel switch SST turns off, the control signal BG is set to a level (off potential: low level in this example) at which the output switch BCT turns off, and the control signal RG is set to a level (on potential: high level in this example) at which the reset switch RST turns on, by the scanning line drive circuits Ydr1 and Ydr2.

The output switch BCT and the pixel switch SST turn off (nonconductive state), and the reset switch RST turns on (conductive state) to start the source initialization operation. When the reset switch RST turns on, the source and the drain of the drive transistor DRT become the same potential as that of the reset power supply Vrst to complete the source initialization operation. In this example, the reset power supply Vrst is set to, for example, −2V.

7-2. Gate Initialization Operation

Second, the gate initialization operation is conducted. In the gate initialization operation, the control signal SG is set to a level (on potential: high level in this example) at which the pixel switch SST turns on, the control signal BG is set to a level (off potential: low level in this example) at which the output switch BCT turns off, and the control signal RG is set to a level (on potential: high level in this example) at which the reset switch RST turns on, by the scanning line drive circuits Ydr1 and Ydr2.

The output switch BCT turns off (nonconductive state), and the pixel switch SST and the reset switches RST turn on (conductive state) to start the gate initialization operation.

In a gate initialization period during which the gate initialization operation is conducted, the initialization voltage Vini output from the video signal lines is applied to the gate of the drive transistor DRT through the pixel switch SST. With this operation, the gate potential of the drive transistor DRT is reset to a potential corresponding to the initialization voltage Vini to initialize information on a previous frame.

The initialization voltage Vini is calculated by the arithmetic unit 20 according to the gradation voltage signals Vsig input to the initialization voltage circuits 16, and the calculated result is output when the switch 22 is in an on state. This calculation method will be described later.

7-3. Offset Cancel Operation

Third, the offset cancel operation is conducted. The control signal SG becomes on potential (high level), the control signal BG becomes on potential (high level), and the control signal RG becomes off potential (low level). With this operation, the respective reset switches RST become off (nonconductive state), and the pixel switch SST and the output switch BCT become on (conductive state), to thereby start the offset cancel operation of a threshold value.

In an offset cancel period during which the offset cancel operation is conducted, the gate potential of the drive transistor DRT is output from the video signal line, and the initialization voltage Vini is applied through the pixel switch SST, and fixed. If the initialization voltage Vini is fixed, the switch 22 turns off to stop an output from the arithmetic unit 20, and the switch 24 led to the storage unit 18 turns on.

Also, the output switch BCT is in the on state, and a current flows into the drive transistor DRT from the high-potential voltage power supply line Pvdd. The source potential of the drive transistor DRT is shifted to a high potential side with the absorption and compensation of the TFT characteristic variation of the drive transistor DRT while gradually decreasing the amount of current flowing through the drain and the source of the drive transistor DRT, with the potential Vrst written in the reset period as an initial value. In this embodiment, the offset cancel period is set to a time of, for example, about 1 μs.

At the end time of the offset cancel period, the source potential of the drive transistor DRT becomes Vini−Vth. Vth is a threshold voltage of the drive transistor DRT. With this operation, a voltage between the gate and the source of the drive transistor DRT arrives at a cancel point, and a potential difference corresponding to the cancel point is stored in the retention capacitor Cs.

7-4. Video Signal Write Operation

Fourth, in the video signal write operation, the control signal SG is set to a level (on potential: high level in this example) at which the pixel switch SST turns on, the control signal BG is set to a level (on potential: high level in this example) at which the output switch BCT turns on, and the control signal RG is set to a level (off potential: low level in this example) at which the reset switch RST turns off.

The pixel switch SST and the output switch BCT turn on (conductive state), and the reset switch RST turns off (nonconductive state) to start the video signal write operation.

In a video signal write period during which the video signal write operation is conducted, the gradation voltage signals Vsig is written to the gate of the drive transistor DRT from the video signal lines (1 to n) through the pixel switch SST.

Also, a current flows into the low-potential voltage power supply line Pvss from the high-potential voltage power supply line Pvdd through the drive transistor DRT and the parasitic capacitor Cel of the organic EL element OE.

Immediately after the pixel switch SST turns on, the gate potential of the drive transistor DRT becomes Vsig (R, G, B), and the source potential of the drive transistor DRT becomes Vini−Vth+Cs(Vsig−Vini)/(Cs+Cel+Cad).

Thereafter, a current flows into the low-potential voltage power supply line Pvss through the parasitic capacitor Cel of the organic EL element OE, and at the time of ending the video signal write period, the gate potential of the drive transistor DRT becomes Vsig (R,G,B), and the source potential of the drive transistor DRT becomes Vini−Vth+ΔV1+Cs (Vsig−Vini)/(Cs+Cel+Cad). With this operation, a variation in the mobility of the drive transistor DRT is corrected.

7-5. Light Emitting Operation

Fifth, in a light emitting period during which the light emitting operation is conducted, the control signal SG is set to a level (off potential: low level in this example) at which the pixel switch SST turns off, the control signal BG is set to a level (on potential: high level in this example) at which the output switch BCT turns on, and the control signal RG is set to a level (off potential: low level in this example) at which the reset switch RST turns off.

The output switch BCT turns on (conductive state), and the pixel switch and the reset switch RST turnoff (nonconductive state) to start the light emitting operation.

The drive transistor DRT outputs a drive current Ie having the amount of current corresponding to a gate control voltage written in the retention capacitor Cs. The drive current Ie is supplied to the organic EL element OE. With the above operation, the organic EL element OE emits light with brightness corresponding to the drive current Ie to conduct the light emitting operation. The organic EL element OE maintains a light emitting state until the control signal BG becomes off potential again after one frame period.

The source initialization operation, the gate initialization operation, the offset cancel operation, the video signal write operation, and the light emitting operation described above are sequentially repeated in each pixel unit PX to display a desired image.

8. Initialization Voltage Vini

Subsequently, a description will be given of the initialization voltage Vini applied in the gate initialization operation and the offset cancel operation with reference to FIGS. 5 to 7.

Figure 5:
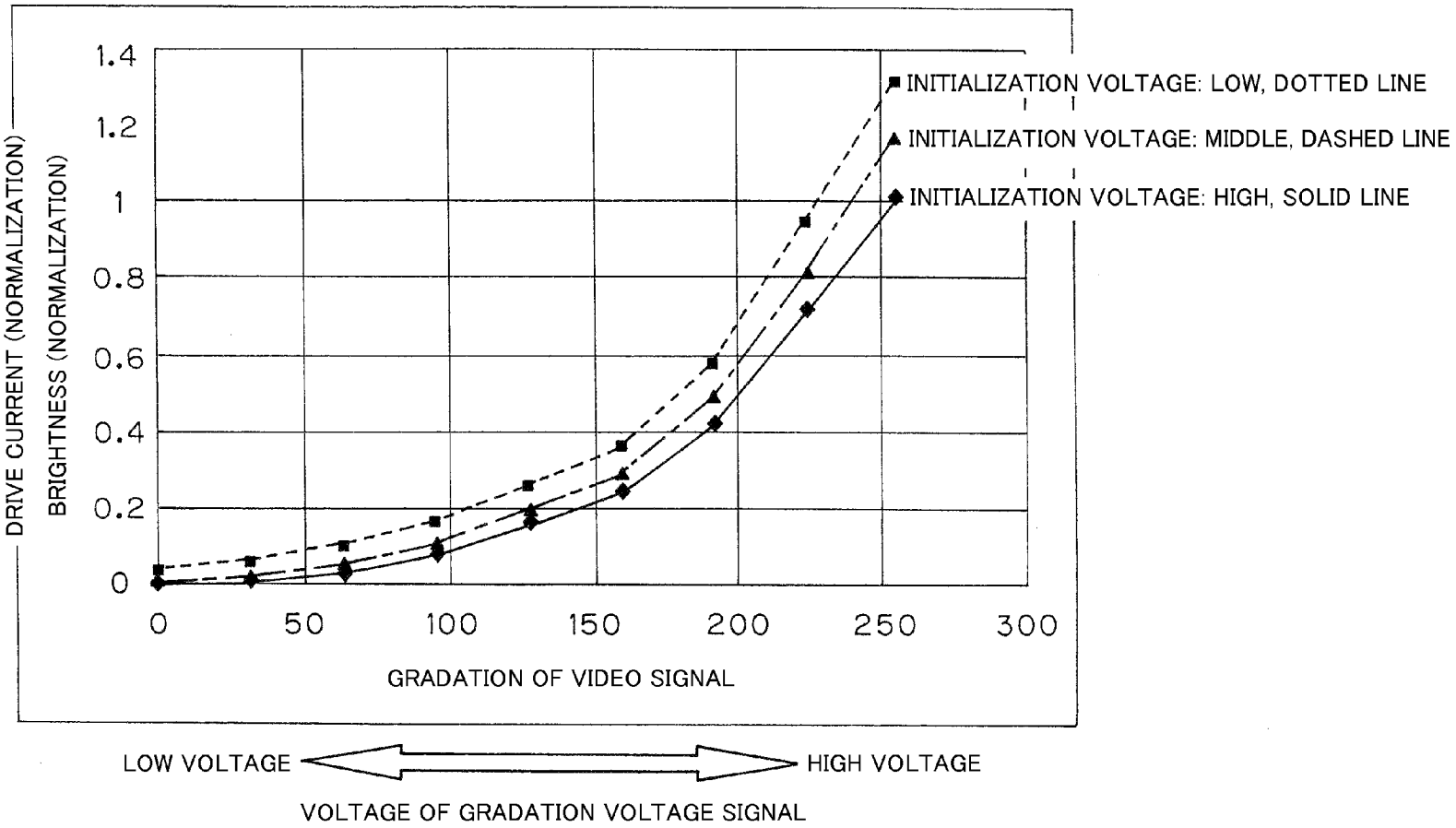
FIG. 5 is a graph illustrating a relationship between a drive current (brightness) and a gradation voltage signal.

FIG. 5 is a graph illustrating a change in the drive current Ie when the initialization voltage Vini is variable, that is, the brightness of the organic EL element OE. The drive current Ie and the brightness are normalized. In this graph, the axis of abscissa represents a voltage value of the gradation voltage signal Vsig (corresponding to the analog video signal), and the axis of ordinate is a normalized brightness. A solid line represents a case in which the initialization voltage Vini is high (for example, 2.25V), a dashed line represents a case in which the initialization voltage Vini is medium (for example, 2V), and a dotted line represents a case in which the initialization voltage Vini is low (for example, 1.75V).

As illustrated in FIG. 5, the present applicant has ascertained that the drive current Ie increases in a range of all gradations if the initialization voltage Vini is low whereas the drive current Ie decreases in a range of all gradations if the initialization voltage Vini is high. In this case, in order to set the brightness of the display device 10 to be high, there is a need to set the initialization voltage Vini to be low. On the contrary, the brightness of black display becomes high, and a black emerging phenomenon is generated.

Figure 6A:
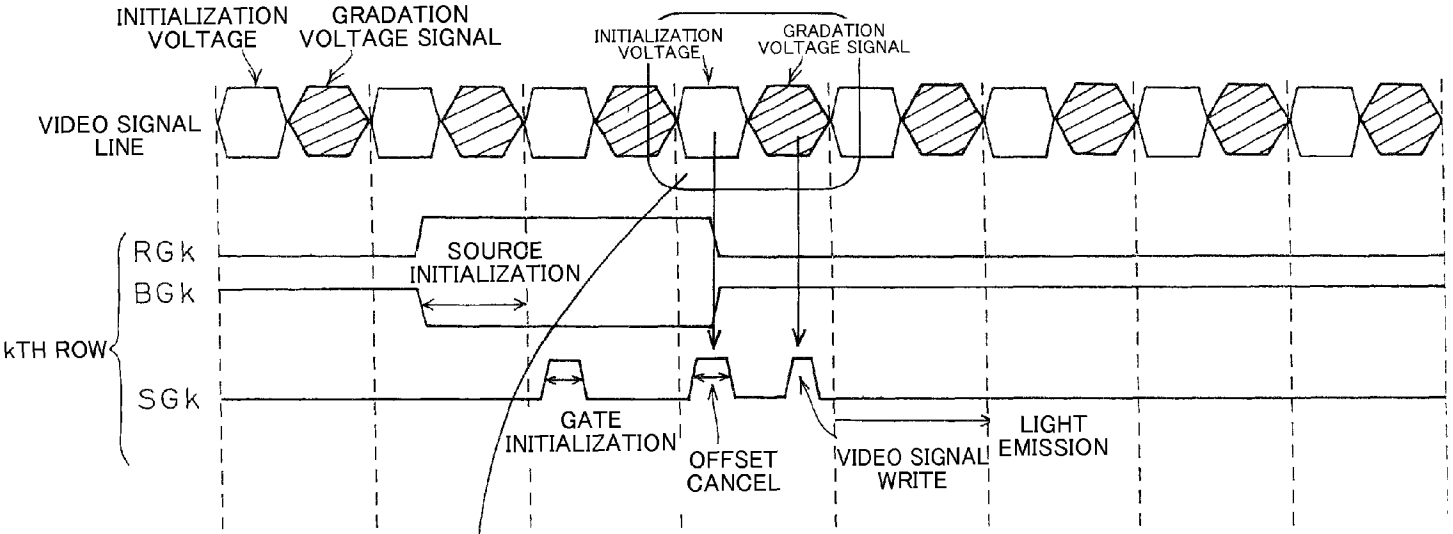
FIG. 6A is a timing chart of the control signal of the scanning line drive circuit for a k-th row.
Figure 6B:
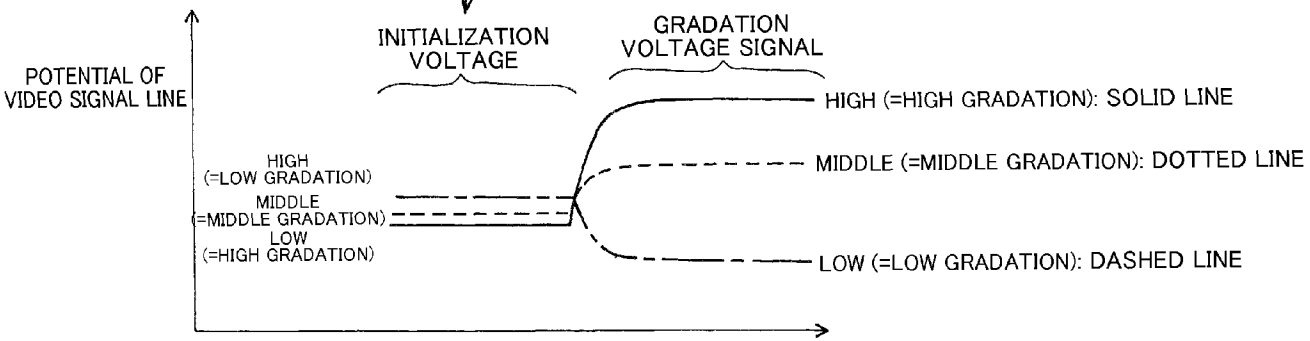
FIG. 6B is a graph illustrating a process of a potential of video signal lines.

FIG. 6A is a timing chart of the control signals RG, BG, and SG of the scanning line drive circuits Ydr1 and Ydr2 as in FIG. 4, and illustrates only a k-th row. FIG. 6B is a graph illustrating a change in the initialization voltage and the gradation voltage signal Vsig in FIG. 6A in which the axis of ordinate represents the potential of the video signal line, and the axis of abscissa represents a time axis.

As illustrated in FIG. 6, in order to prevent a problem that the brightness of the black display emerges described above, the video signal (gradation voltage signals Vsig) after the initialization voltage Vini has been applied is grasped in advance, and the initialization voltage Vini corresponding to the video signal is written to allow a higher drive current Ie (higher brightness) to flow on a higher gradation side, and a lower drive current Ie (lower brightness) to flow on a lower gradation side (black side) under control as illustrated in FIG. 6B. Specifically, when the gradation voltage signal Vsig is high voltage, the initialization voltage Vini is high, and the initialization voltage Vini is set to be higher as the gradation voltage signals Vsig are lower.

Figure 7:
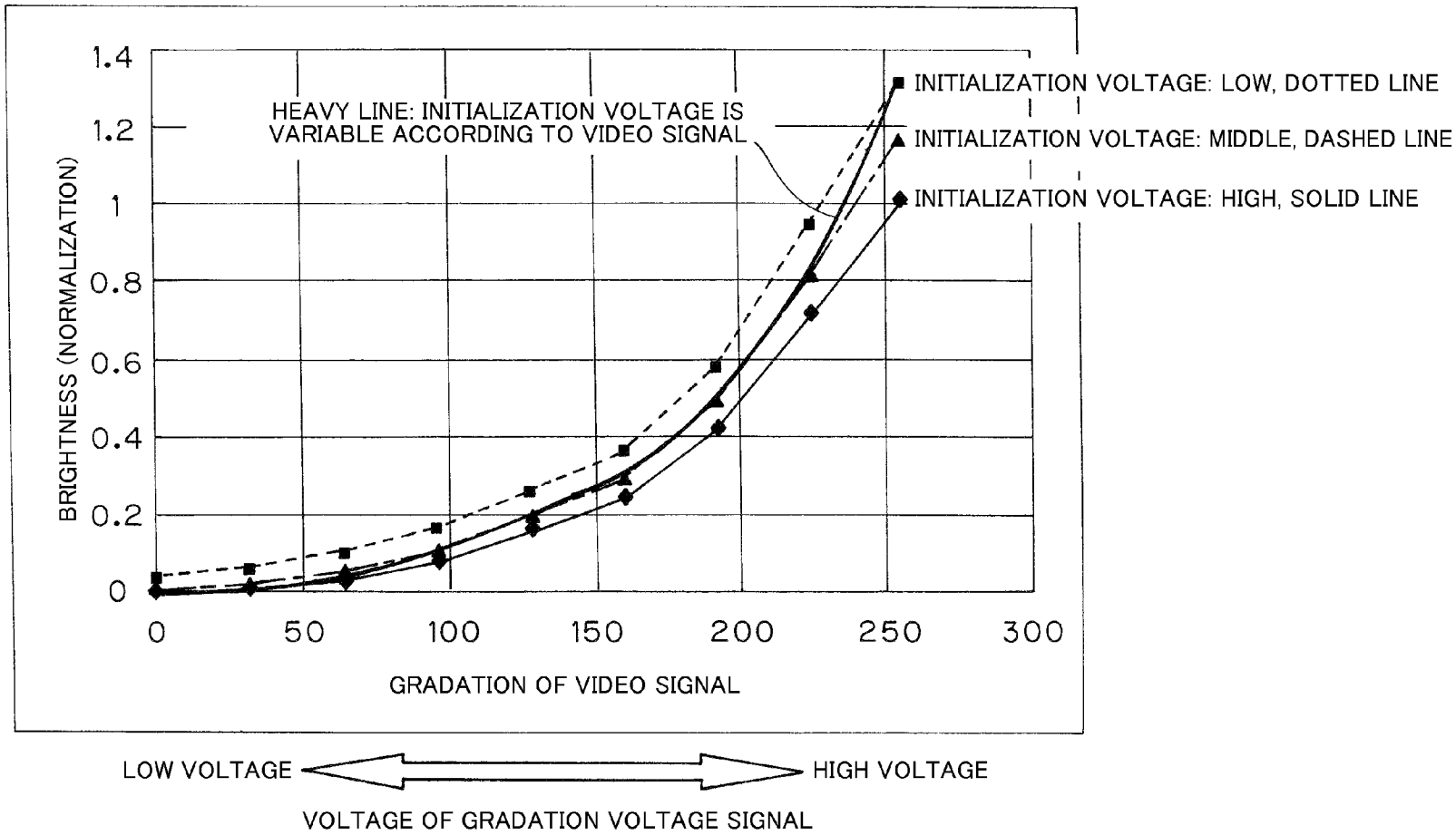
FIG. 7 is a graph illustrating an initialization voltage output by an arithmetic unit of an initialization voltage circuit in which the axis of ordinate represents brightness, and the axis of abscissa is a gradation voltage signal.

FIG. 7 is a graph illustrating a relationship between the gradation voltage signals Vsig and the drive current Ie when the initialization voltage Vini is varied according to the gradation voltage signal Vsig, in which the higher gradation side increases the drive current Ie of about 30% without increasing the drive current Ie of the lower gradation (black side).

In order to realize the relationship in FIG. 7, in the initialization voltage circuit 16, the arithmetic unit 20 stores a table of the relationship illustrated in FIG. 7 therein, calls the initialization voltage Vini corresponding to the voltage (that is, gradation value) of the gradation voltage signal Vsig from the table, and outputs the initialization voltage Vini from the arithmetic unit 20. The operation will be described.

First, in the gate initialization operation, the arithmetic unit 20 calls the initialization voltage Vini corresponding to the voltage of the gradation voltage signal Vsig from the table, turns on the switch 22, and outputs the initialization voltage Vini from the arithmetic unit 20. Also, while the arithmetic unit 20 conducts the arithmetic operation, the gradation voltage signals Vsig is stored in the storage unit (for example, a frame memory), and the switch 24 is kept off.

Then, in the offset cancel operation, at the time when the arithmetic operation of the arithmetic unit 20 is completed, and the initialization voltage Vini is applied and fixed, the switch 22 turns off, the switch 24 turns on, and the gradation voltage signal Vsig is amplified by the amplifier 26, and output from the video signal line.

Because the initialization voltage circuits 16 are provided for every video signal line, the initialization voltage Vini can be applied according to the gradation voltage signals Vsig of RGBW. As a result, because the drive current Ie of the lower gradation (black side) does not increase, and the drive current Ie becomes high on the high gradation side as described above, the brightness of the display device 10 can increase, and the dynamic range and the contrast can be also improved.

9. Advantages

According to the display device 10 of this embodiment, the initialization voltage Vini becomes lower as the gradation voltage signal Vsig increases more. As a result, the drive current Ie of the lower gradation (black side) does not increase, and the drive current Ie on the higher gradation side can increase so that the dynamic range and the contrast can be improved.

Also, in the light emitting period, the drive current Ie flowing in the organic EL element OE is represented as a current value of a saturated area of the drive transistor DRT as follows.

$$Ie=\beta\times\{(Vsig-Vini-\Delta V1)\times Cel/(Cs+Cel+Cad)\}2 \quad (1)$$

$$\beta=\mu\times Co\times W/2L \quad (2)$$

where W is a channel width, L is a channel length, μ is mobility, and Co is a capacitance of a gate insulting film per unit area.

The drive current Ie that flows in the organic EL element OE becomes a value not depending on a threshold value Vth of the drive transistor DRT. For that reason, an influence of a variation in the threshold value of the drive transistor DRT can be excluded.

Also, because ΔV1 becomes a larger value in absolute value as the mobility of the drive transistor DRT is larger, an influence of the mobility can be also compensated. Therefore, the occurrence of display failure, banding, or rough feeling caused by the above variation can be suppressed to conduct high-quality image display.

Second Embodiment

Figure 8:
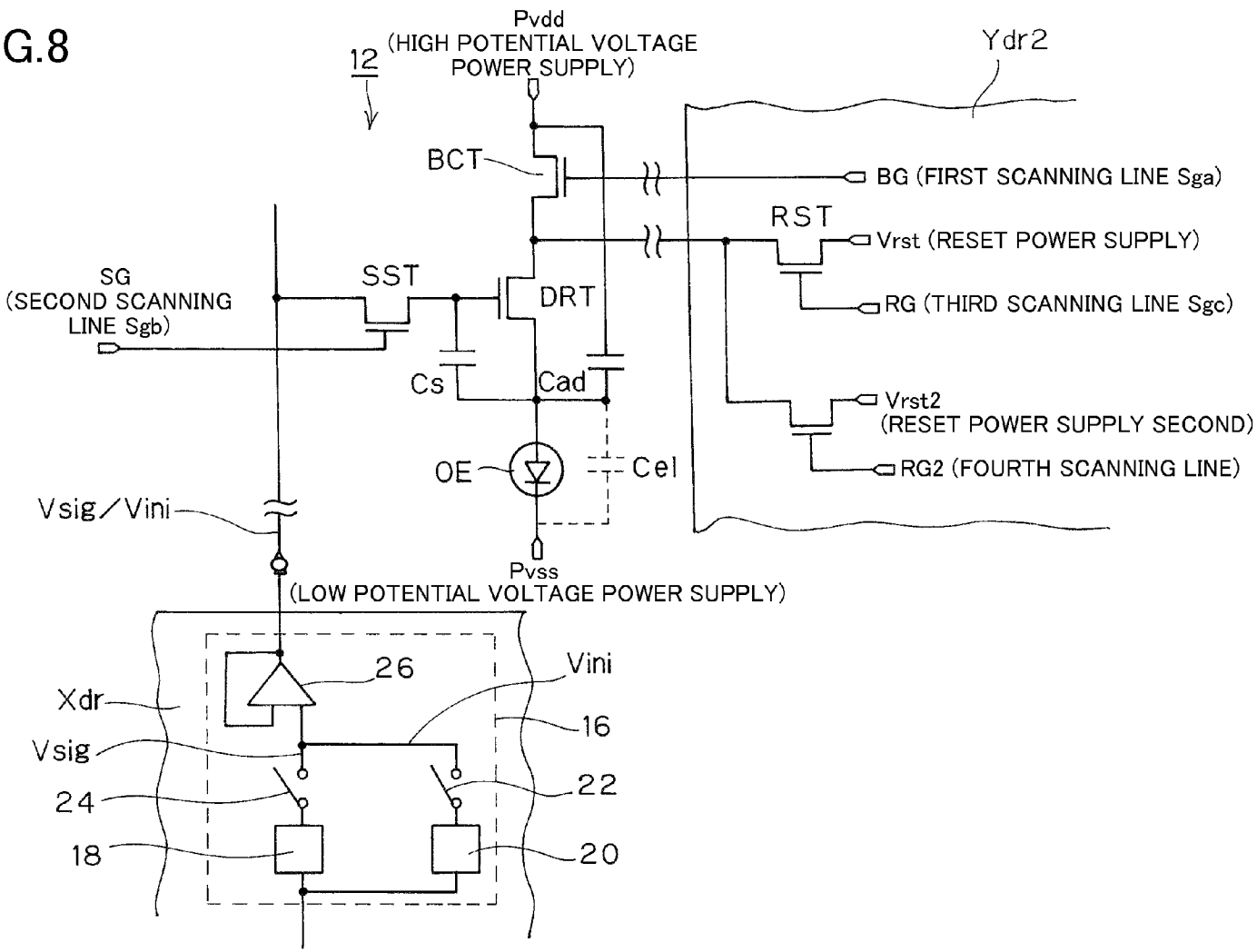
FIG. 8 is a diagram illustrating a pixel circuit according to a second embodiment.
Figure 9:
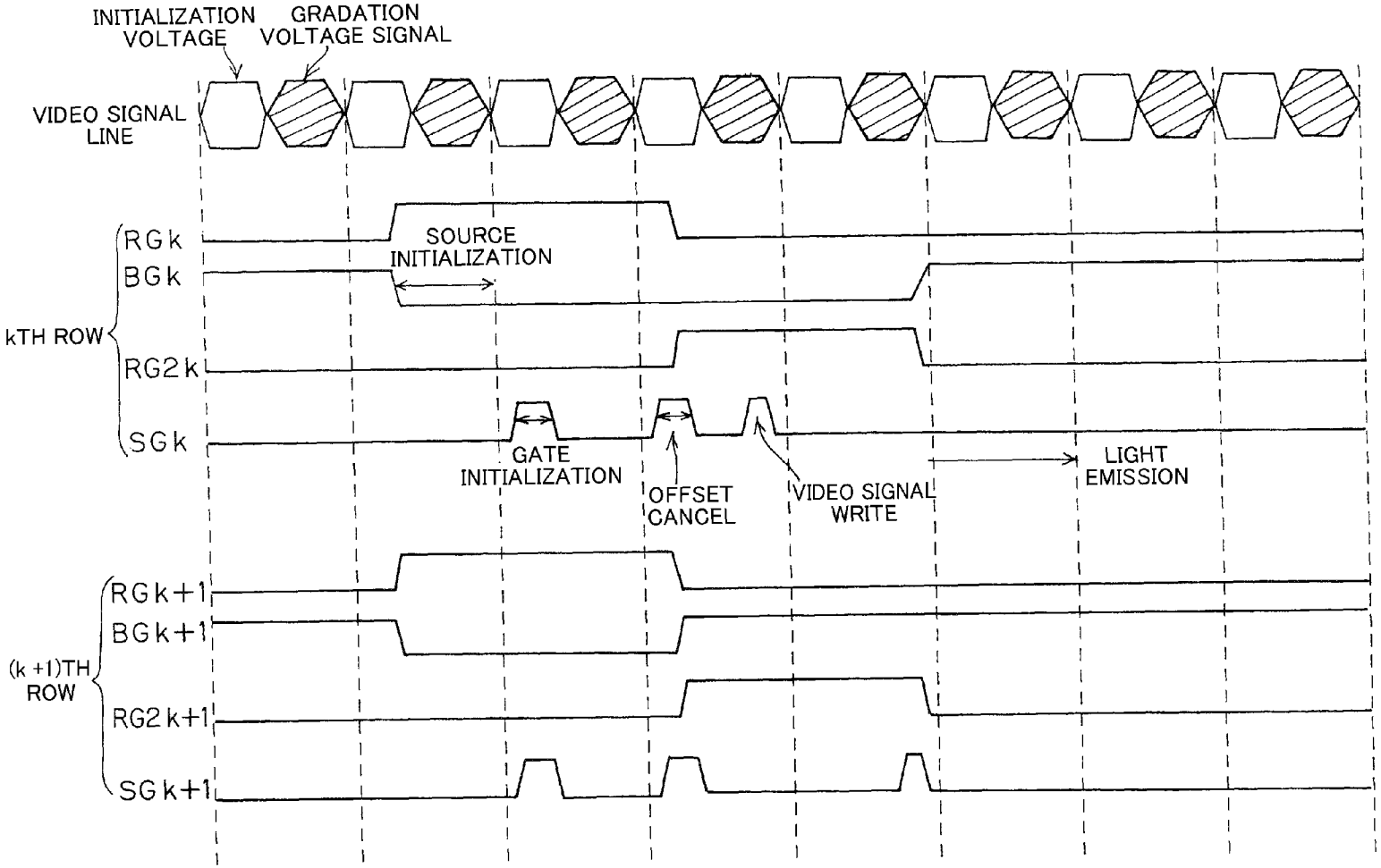
FIG. 9 is a timing chart of the control signal of the scanning line drive circuit.

Subsequently, a description will be given of the display device 10, and the method for driving the display device 10 according to a second embodiment with reference to FIGS. 8 and 9.

This embodiment is different from the first embodiment in that fourth scanning lines Sgd (1 to m), second reset switches RST2, and a second reset power supply Vrst2 are provided in addition to the first scanning lines Sga (1 to m), the second scanning lines Sgb (1 to m), the third scanning lines Sgc (1 to m), and the reset switches RST.

A scanning line drive circuit Ydr2 has the second reset switch RST2 for every line, and the second reset switches RST2 are each connected between the drain of the drive transistor DRT and the second reset power supply Vrst2. A gate of each of the second reset switches RST2 is connected to the corresponding fourth scanning line Sgd (1 to m) that functions as a second reset control gate line. Each of the second reset switches RST2 is controlled to on (conductive state) or off (nonconductive state) according to a control signal RG2 (1 to m) from the fourth scanning line Sgd (1 to m) to initialize the source potential of the drive transistor DRT.

1. Operation of Display Device 10

As in the first embodiment, the operation of the pixel circuit 12 in the display device 10 according to this embodiment is classified into the source initialization operation, the gate initialization operation, the offset cancel operation, the video signal write operation, and the light emitting operation.

2-1. Source Initialization Operation

First, the source initialization operation is conducted. In the source initialization operation, the control signal SG is set to a level (off potential: low level in this example) at which the pixel switch SST turns off, the control signal BG is set to a level (off potential: low level in this example) at which the output switch BCT turns off, and the control signal RG is set to a level (on potential: high level in this example) at which the reset switch RST turns on, by the scanning line drive circuits Ydr1 and Ydr2.

The output switch BCT, the pixel switch SST, and the second reset switches RST2 turn off (nonconductive state), and the reset switch RST turns on (conductive state) to start the source initialization operation. When the reset switch RST turns on, the source and the drain of the drive transistor DRT become the same potential as that of the reset power supply Vrst to complete the source initialization operation. In this example, the reset power supply Vrst is set to, for example, −2V.

2-2. Gate Initialization Operation

Second, the gate initialization operation is conducted. In the gate initialization operation, the control signal SG is set to a level (on potential: high level in this example) at which the pixel switch SST turns on, the control signal BG is set to a level (off potential: low level in this example) at which the output switch BCT turns off, the control signal RG is set to a level (on potential: high level in this example) at which the reset switch RST turns on, and the control signal RG2 is set to a level (off potential: low level in this example) at which the second reset switches RST2 turn off, by the scanning line drive circuits Ydr1 and Ydr2.

The output switch BCT and the second reset switches RST2 turn off (nonconductive state), and the pixel switch SST and the reset switch RST turn on (conductive state) to start the gate initialization operation.

In a gate initialization period during which the gate initialization operation is conducted, the initialization voltage Vini output from the video signal lines is applied to the gate of the drive transistor DRT through the pixel switch SST. With this operation, the gate potential of the drive transistor DRT is reset to a potential corresponding to the initialization voltage Vini to initialize information on a previous frame.

As in the first embodiment, the initialization voltage Vini calculated by the arithmetic unit 20 of the initialization voltage circuit 16 which is disposed within the signal line drive circuit Xdr is output. The initialization voltage Vini is calculated to be lower as the gradation voltage signal Vsig stored in the storage unit 18 is higher.

2-3. Offset Cancel Operation

Third, the offset cancel operation is conducted. The control signal SG becomes on potential (high level), the control signal BG becomes off potential (low level), the control signal RG becomes off potential (low level), and the control signal RG2 becomes on potential (high level). With this operation, the respective reset switches RST and the output switch BCT become off (nonconductive state), and the pixel switch SST and the second reset switch RST2 become on (conductive state), to thereby start the offset cancel operation of a threshold value.

In an offset cancel period during which the offset cancel operation is conducted, the gate potential of the drive transistor DRT is output from the video signal line, and the initialization voltage Vini is applied through the pixel switch SST, and fixed.

Also, the second reset switches RST2 is in the on state, and a current flows into the drive transistor DRT from the second reset power supply Vrst2. The second reset power supply Vrst2 is set to, for example, 5V. The source potential of the drive transistor DRT is shifted to a high potential side with the absorption and compensation of the TFT characteristic variation of the drive transistor DRT while gradually decreasing the amount of current flowing through the drain and the source of the drive transistor DRT, with the potential Vrst written in the reset period as an initial value. In this embodiment, the offset cancel period is set to a time of, for example, about 1 μs.

At the end time of the offset cancel period, the source potential of the drive transistor DRT becomes Vini−Vth. Vth is a threshold voltage of the drive transistor DRT. With this operation, a voltage between the gate and the source of the drive transistor DRT arrives at a cancel point, and a potential difference corresponding to the cancel point is stored in the retention capacitor Cs.

2-4. Video Signal Write Operation

Fourth, in the video signal write period during which the video signal write operation is conducted, the control signal SG is set to a level (on potential: high level in this example) at which the pixel switch SST turns on, the control signal BG is set to a level (off potential: low level in this example) at which the output switch BCT turns off, the control signal RG is set to a level (off potential: low level in this example) at which the reset switch RST turns off, and the control signal RG2 is set to a level (on potential: high level in this example) at which the second reset switch RST2 turns on.

The pixel switch SST and the second reset switch RST2 turn on (conductive state), and the output switch BCT and the reset switch RST turns off (nonconductive state) to start the video signal write operation.

In the video signal write period, the gradation voltage signals Vsig is written to the gate of the drive transistor DRT from the video signal lines (1 to n) through the pixel switch SST. Also, a current flows into the low-potential voltage power supply line Pvss from the second reset power supply Vrst2 through the drive transistor DRT and the parasitic capacitor Cel of the organic EL element OE. Immediately after the pixel switch SST turns on, the gate potential of the drive transistor DRT becomes Vsig (R, G, B), and the source potential of the drive transistor DRT becomes Vini−Vth+Cs (Vsig−Vini)/(Cs+Cel+Cad).

Thereafter, a current flows into the low-potential voltage power supply line Pvss through the parasitic capacitor Cel of the organic EL element OE, and at the time of ending the video signal write period, the gate potential of the drive transistor DRT becomes Vsig (R,G,B), and the source potential of the drive transistor DRT becomes Vini−Vth+ΔV1+Cs (Vsig−Vini)/(Cs+Cel+Cad). With this operation, a variation in the mobility of the drive transistor DRT is corrected.

2-5. Light Emitting Operation

Fifth, in the light emitting period during which the light emitting operation is conducted, the control signal SG is set to a level (off potential: low level in this example) at which the pixel switch SST turns off, the control signal BG is set to a level (on potential: high level in this example) at which the output switch BCT turns on, the control signal RG is set to a level (off potential: low level in this example) at which the reset switch RST turns off, and the control signal RG2 is set to a level (off potential: low level in this example) at which the second reset switch RST2 turns off.

The output switch BCT turns on (conductive state), and the pixel switch, the reset switch RST, and the second reset switches RST2 turn off (nonconductive state) to start the light emitting operation.

The drive transistor DRT outputs a drive current Ie having the amount of current corresponding to a gate control voltage written in the retention capacitor Cs. The drive current Ie is supplied to the organic EL element OE. With the above operation, the organic EL element OE emits light with brightness corresponding to the drive current Ie to conduct the light emitting operation. The organic EL element OE maintains a light emitting state until the control signal BG becomes off potential again after one frame period.

The source initialization operation, the gate initialization operation, the offset cancel operation, the video signal write operation, and the light emitting operation described above are sequentially repeated in each pixel unit PX to display a desired image.

[3. Advantages]

According to the display device 10 of this embodiment, the initialization voltage Vini becomes lower as the gradation voltage signal Vsig is higher. As a result, the drive current Ie of the lower gradation (black side) does not increase, and the drive current Ie on the higher gradation side can increase so that the dynamic range and the contrast can be improved.

Also, as represented by Expressions (1) and (2) of the first embodiment, in the light emitting period, the drive current Ie that flows in the organic EL element OE becomes a value not depending on a threshold value Vth of the drive transistor DRT. For that reason, an influence of a variation in the threshold value of the drive transistor DRT can be excluded.

Also, because ΔV1 becomes a larger value in absolute value as the mobility of the drive transistor DRT is larger, an influence of the mobility can be also compensated. Therefore, the occurrence of display failure, banding, or rough feeling caused by the above variation can be suppressed to conduct high-quality image display.

(Modifications)

Modifications of the above respective embodiments will be described.

1. Modification 1

Figure 10:
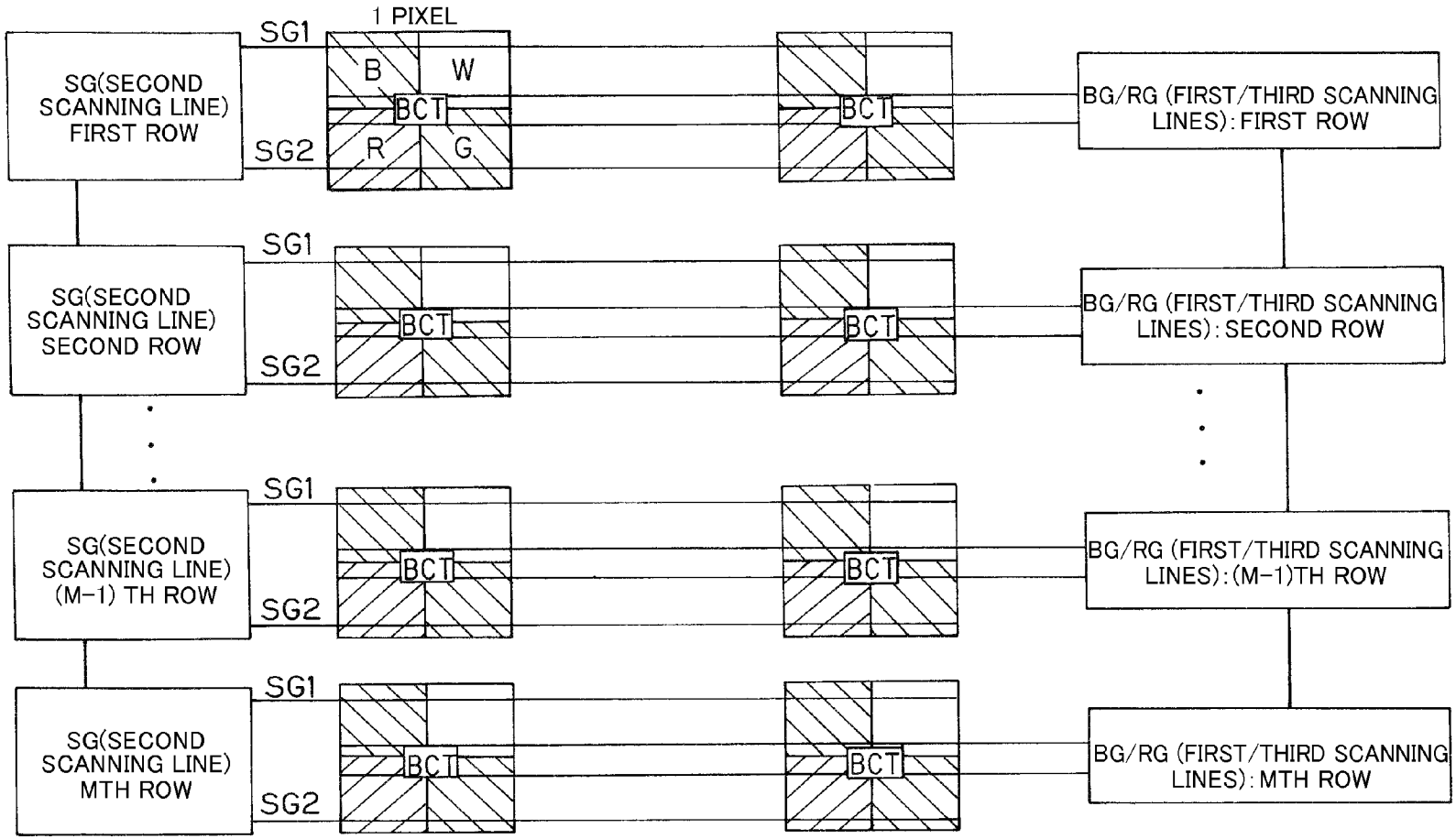
FIG. 10 is a diagram of a scanning line layout image of square pixels of RGBW.

Another layout image of the scanning lines will be described with reference to FIG. 10. FIG. 10 illustrates a scanning line layout image of RGBW square pixels.

In the scanning line layout image of the RGBW square pixels, any two (for example, pixel units for R (red) display and G (green) display) of the pixel units PX for R (red) display, G (green) display, B (blue) display, and W (white) display are connected to even rows, and the remaining two pixel units PX (for example, pixel units for B (blue) display and W (white) display) are connected to odd rows.

In this situation, the output switch BCT is shared by four pixel units PX for R (red) display, G (green) display, B (blue) display, and W (white) display.

Also, in the scanning line layout image of the vertical stripe pixels of three colors, three pixel units PX for R (red) display, G (green) display, and B (blue) display may be connected to each row.

2. Modification 2

Plural offset cancel periods during which the offset cancel operation is conducted may be provided as occasion demands.

3. Modification 3

The semiconductor layer of the thin film transistor (TFT) is not limited to polysilicon, but can be made of amorphous silicon.

The transistors of the respective switches and the drive transistor DRT are not limited to the n-channel type, but may be of a p-channel type.

Likewise, the reset switches RST or the second reset switches RST2 are not limited to the p-channel type, but may be of the n-channel type.

The shapes and the dimensions of the transistors and the switches are not limited to the above-mentioned embodiments, but can be changed as occasion demands.

4. Modification 4

Each of the output switches BCT is shared by four pixel units, but is not limited to this configuration. The number of output switches BCT can increase or decrease as occasion demands. Further, the self-luminous elements configuring the pixel units PX are not limited to the organic EL element OE, but can be applied with a variety of self-luminous display elements.

5. Others

The present invention is not limited to the above embodiments without any change, but can modify and embody the components without departing from the spirit of the invention in an implementation stage. Also, the present invention can be diversified by an appropriate combination of the plural components disclosed in the embodiments. For example, several components may be deleted from all of the components illustrated in the embodiments. Further, the components in the different embodiments may be appropriately combined together.

While there have been described what are at present considered to be certain embodiments of the invention, it will be understood that various modifications may be made thereto, and it is intended that the appended claim cover all such modifications as fall within the true spirit and scope of the invention.

What is claimed is:

1. A display device, comprising:

a plurality of pixel units that are arrayed on a substrate in a matrix, and each having a drive transistor, an output switch, a retention capacitor, a pixel switch, a light emitting element, and a pixel circuit that supplies a drive current to the light emitting element;

a plurality of first scanning lines, a plurality of second scanning lines, and a plurality of third scanning lines, which are plural kinds of scanning lines arranged along rows in which the pixel units are arrayed;

a plurality of video signal lines that are arranged along columns in which the pixel units are arrayed;

a plurality of reset lines that are arranged along the rows;

a high-potential voltage power supply line, and a low-potential voltage power supply line;

a scanning line drive circuit that includes a plurality of reset switches, sequentially supplies a control signal to the plural kinds of scanning lines, and line-sequentially scans the pixel units line by line; and a signal line drive circuit that supplies a gradation voltage signal corresponding to the video signal to the video signal lines according to the line-sequentially scanning operation, wherein the drive transistor is connected in series with the light emitting element between the low-potential voltage power supply line and the high-potential voltage power supply line, a first terminal of the drive transistor is connected to the light emitting element, and a second terminal of the drive transistor is connected to the corresponding reset line, wherein a first terminal of the output switch is connected to a high-potential voltage power supply, a second terminal of the output switch is connected to the second terminal of the drive transistor, and a control terminal of the output switch is connected to the corresponding first scanning line, wherein the retention capacitor is connected between the first terminal of the drive transistor and a control terminal of the drive transistor, wherein a first terminal of the pixel switch is connected to the corresponding video signal line, a second terminal of the pixel switch is connected to the control terminal of the drive transistor, and a control terminal of the pixel switch is connected to the corresponding second scanning line, and the pixel switch captures the gradation voltage signal from the corresponding video signal line, and retains the gradation voltage signal in the retention capacitor, wherein the output switch is shared by four of the pixel units adjacent to each other in a row direction and a column direction, wherein the respective reset switches are disposed for every reset line, a first terminal of each of the reset switches is connected to a reset power supply, a second terminal of the reset switch is connected to the corresponding reset line, and a control terminal of the reset switch is connected to the corresponding third scanning line, and wherein the signal line drive circuit applies an initialization voltage to the control terminal of the drive transistor from the corresponding video signal line, applies a reset potential to the first terminal of the drive transistor from the corresponding reset line to initialize the drive transistor, and the initialization voltage is set to a lower value as a voltage value of the gradation voltage signal written after offset cancellation for offset-canceling a threshold value of the drive transistor is higher.

2. The display device according to claim 1, wherein the pixel units include pixel units of four colors having a red display pixel unit, a green display pixel unit, a blue display pixel unit, and a white display pixel unit, wherein the red display pixel unit, the green display pixel unit, the blue display pixel unit, and the white display pixel unit are disposed adjacent to each other in the row direction and the column direction, and wherein the output switch is shared by the pixel units of four colors.

3. The display device according to claim 2, wherein the scanning line drive circuit further includes a plurality of second reset switches, and wherein the second reset switches are disposed for every reset line, a first terminal of each of the second reset switches is connected to a second reset power supply, a second terminal of the second reset switch is connected to the corresponding reset line, and a control terminal of the second reset switch is connected to a fourth scanning line.

4. The display device according to claim 1, wherein the pixel units include pixel units of four colors having a red display pixel unit, a green display pixel unit, a blue display pixel unit, and a white display pixel unit, wherein the red display pixel unit, the green display pixel unit, the blue display pixel unit, and the white display pixel unit are lined up along the row direction, and wherein the output switch is shared by the pixel units of two colors adjacent to each other in the row direction and the column direction.

5. The display device according to claim 4, wherein the scanning line drive circuit further includes a plurality of second reset switches, and wherein the second reset switches are disposed for every reset line, a first terminal of each of the second reset switches is connected to a second reset power supply, a second terminal of the second reset switch is connected to the corresponding reset line, and a control terminal of the second reset switch is connected to a fourth scanning line.

6. The display device according to claim 1, wherein the scanning line drive circuit further includes a plurality of second reset switches, and wherein the second reset switches are disposed for every reset line, a first terminal of each of the second reset switches is connected to a second reset power supply, a second terminal of the second reset switch is connected to the corresponding reset line, and a control terminal of the second reset switch is connected to a fourth scanning line.

* * * * *